US008567479B2

(12) United States Patent
Sana et al.

(10) Patent No.: US 8,567,479 B2
(45) Date of Patent: Oct. 29, 2013

(54) EQUIPMENT FOR MAKING FOUNDRY CORES

(75) Inventors: Giovanni Sana, Bergamo (IT); Oscar Rota, Bergamo (IT); Michele Nessi, Bergamo (IT)

(73) Assignee: Freni Brembo S.p.A., Curno, Bergamo (IT)

( * ) Notice: Subject to any disclaimer, the term of this patent is extended or adjusted under 35 U.S.C. 154(b) by 0 days.

(21) Appl. No.: 13/321,895

(22) PCT Filed: May 18, 2010

(86) PCT No.: PCT/IT2010/000218

§ 371 (c)(1),
(2), (4) Date: Jun. 1, 2012

(87) PCT Pub. No.: WO2010/134114

PCT Pub. Date: Nov. 25, 2010

(65) Prior Publication Data

US 2012/0241119 A1 Sep. 27, 2012

(30) Foreign Application Priority Data

May 22, 2009 (IT) ..... MI2009A0913

(51) Int. Cl.
*B22C 7/06* (2006.01)

(52) U.S. Cl.
USPC ..... 164/228; 164/28

(58) Field of Classification Search
USPC ..... 164/28, 29, 200–202, 228–233
See application file for complete search history.

(56) References Cited

U.S. PATENT DOCUMENTS

| | | | | |
|---|---|---|---|---|
| 2,553,627 | A | 5/1951 | Barlow | |
| 5,042,562 | A | 8/1991 | Schilling | |
| 7,270,166 | B2 * | 9/2007 | Jakus et al. | 164/45 |
| 2009/0189315 | A1 * | 7/2009 | Gunster et al. | 264/442 |

FOREIGN PATENT DOCUMENTS

| | | | |
|---|---|---|---|
| EP | 0 338 601 | A1 | 10/1989 |
| WO | WO 2004/035245 | A1 | 4/2004 |
| WO | WO 2007060157 | A1 * | 5/2007 |

OTHER PUBLICATIONS

Tungsten Carbide, http://www.memsnet.org/material/tungstencarbidewcbulk/, date unknown.*
Light Metals, http://www.thefreedictionary.com/p/Light%20metals), date unknown.*
Thermal Conductivity, http://www.engineeringtoolbox.com/thermal-conductivity-d_429.html, date unknown.*
International Search Report issued in PCT International Application No. PCT/IT2010/000218, mailed on Jan. 28, 2011.

* cited by examiner

*Primary Examiner* — Kevin P Kerns
*Assistant Examiner* — Kevin E Yoon
(74) *Attorney, Agent, or Firm* — Pearl Cohen Zedek Latzer, LLP

(57) ABSTRACT

The present invention concerns equipment (1) for making foundry cores comprising a mold (2) provided with one or more core forms (3) and one or more channels (4, 6, 7) for conveying core formation material to the core forms (3). The equipment comprises one or more inserts (10) housed or able to be housed in the conveying channels (4, 6, 7) near to the core forms (3).

16 Claims, 8 Drawing Sheets

EQUIPMENT FOR MAKING FOUNDRY CORES

CROSS-REFERENCE TO RELATED APPLICATIONS

This application is a National Phase Application of PCT International Application No. PCT/IT2010/000218, International Filing Date, 18 May 2010, claiming priority to Italian Patent Application No. MI2009A000913, filed 22 May 2009, both of which are hereby incorporated by reference in their entirety.

FIELD OF THE INVENTION

The object of the present invention is equipment for the formation of foundry cores.

BACKGROUND

Foundry cores are used to make objects of particular shapes in melting processes. For example, foundry cores can be adopted in melting processes for making perforated metal objects.

Foundry cores are usually made with particular sands for cores, for example so-called "pre-coated" sands, i.e. sands that are dipped in suitable liquid resins so that, when the resin dries out, it covers the initial grains of sand. In order to make the core, the pre-coated sands are suitably worked through specific treatments so as to give the finished core the desired shape and an adequate compactness.

A typical process for forming foundry cores foresees their formation in moulds. Such moulds, usually comprising a first and second half-mould, are provided with one or more core forms, i.e. cavities formed in the moulds having a shape corresponding to the final shape that the core must have. The core forms are connected together by conveying channels through which the sand is inserted inside the preheated mould and conveyed so as to fill all of the core forms. The contact between the walls of the preheated mould and the sand ensures that the resin with which the latter is coated reaches a firing temperature, so as to solidify, compacting the sand. The cores are then removed from the moulds and subjected to precision processing, in particular trimming.

Such equipment for forming cores according to the prior art is not however without drawbacks.

Of course, the solidification of the sand in the mould does not only involve the area of the core forms, but also the areas of the conveying channels. Therefore, what is removed from the mould at the end of the forming process are not separate cores, but rather clusters of cores connected together by further solid parts, corresponding to the conveying channels, in the case in which many core forms are foreseen in the mould, or else a single core to which a solid part is connected corresponding to the injection channel in the case in which a single core form is foreseen in the mould. Such solid parts are commonly known as "burrs". Before proceeding with the precision processing of each of the cores, it is thus necessary to remove the burrs through suitable operations, typically cutting. Such burr removal operations involve an overall lengthening of the core processing cycle.

A further drawback of the described equipment is the waste of sand for cores that forms the burrs, which means a worsening of the overall processing costs of the cores.

SUMMARY

The purpose of the present invention is therefore to provide equipment that allows a reduction in the overall time and cost of the formation cycle of foundry cores.

BRIEF DESCRIPTION OF THE DRAWINGS

In order to better understand the invention and appreciate its advantages some non-limiting example embodiments thereof will be described hereafter, with reference to the attached figures, in which.

DETAILED DESCRIPTION

Figure 1:
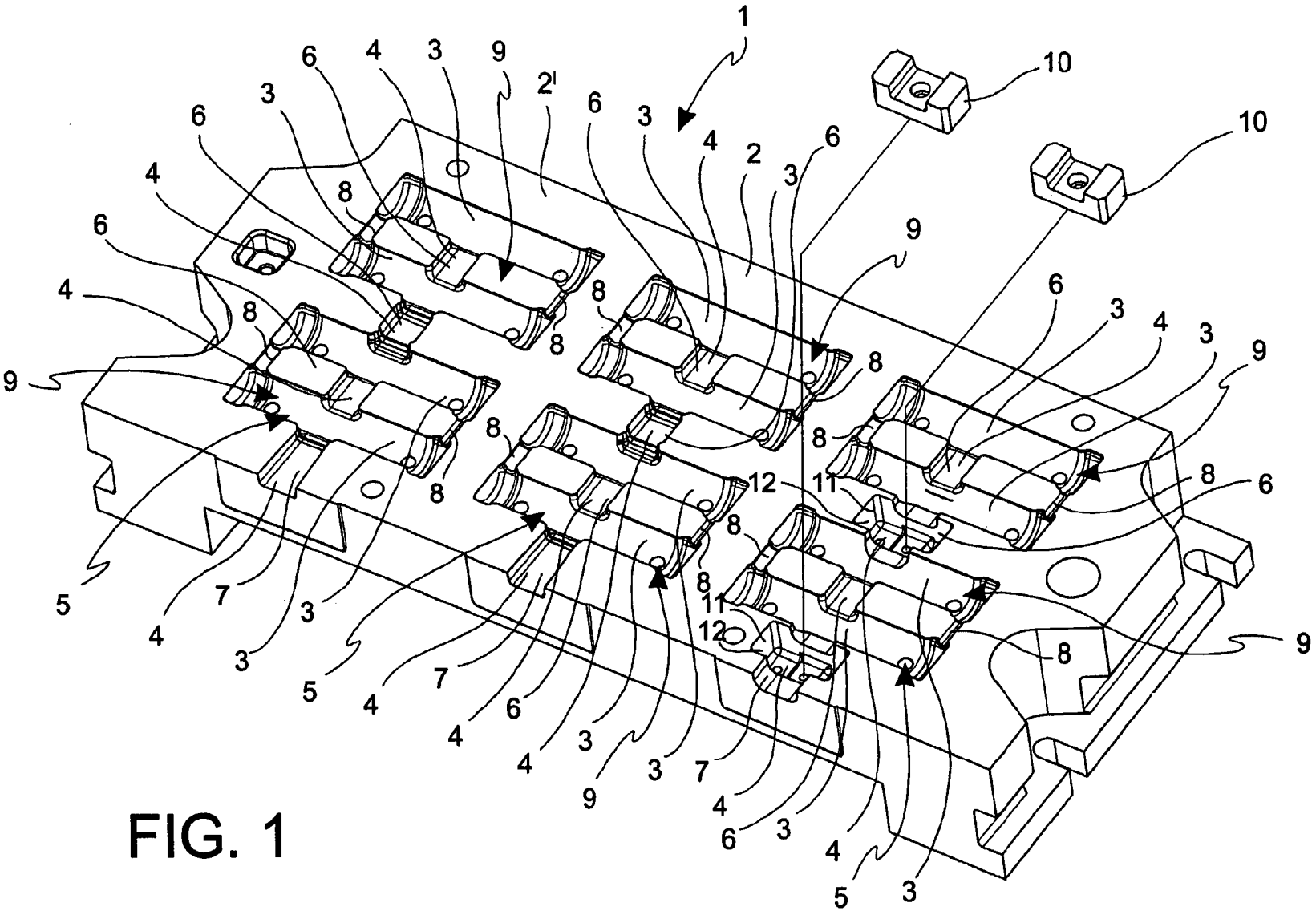
FIG. 1 is an exploded schematic perspective view of part of equipment for forming foundry cores according to the invention.
Figure 2:
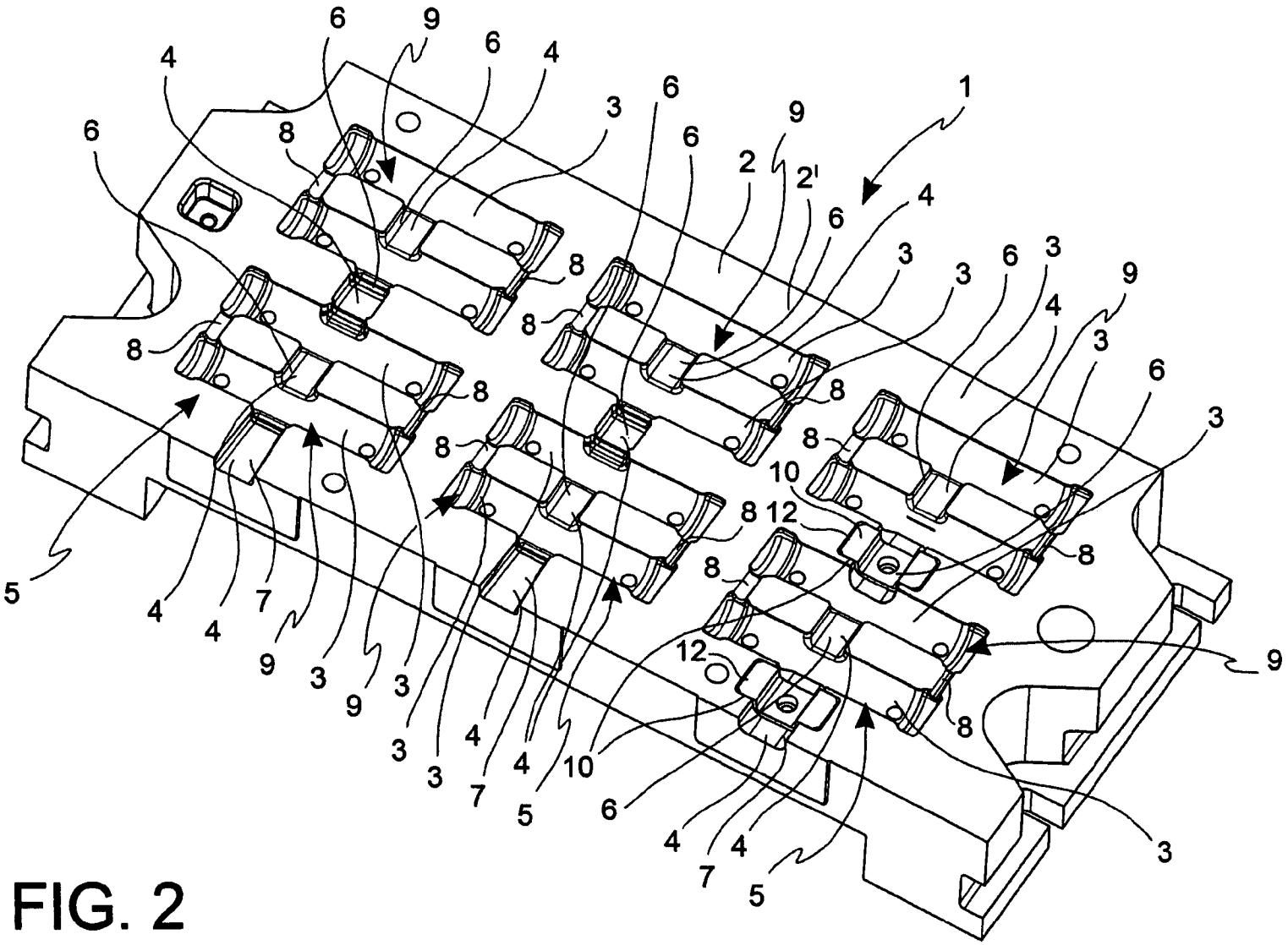
FIG. 2 is a schematic perspective view, in assembled conditions, of the part of equipment in FIG. 1.
Figure 3:
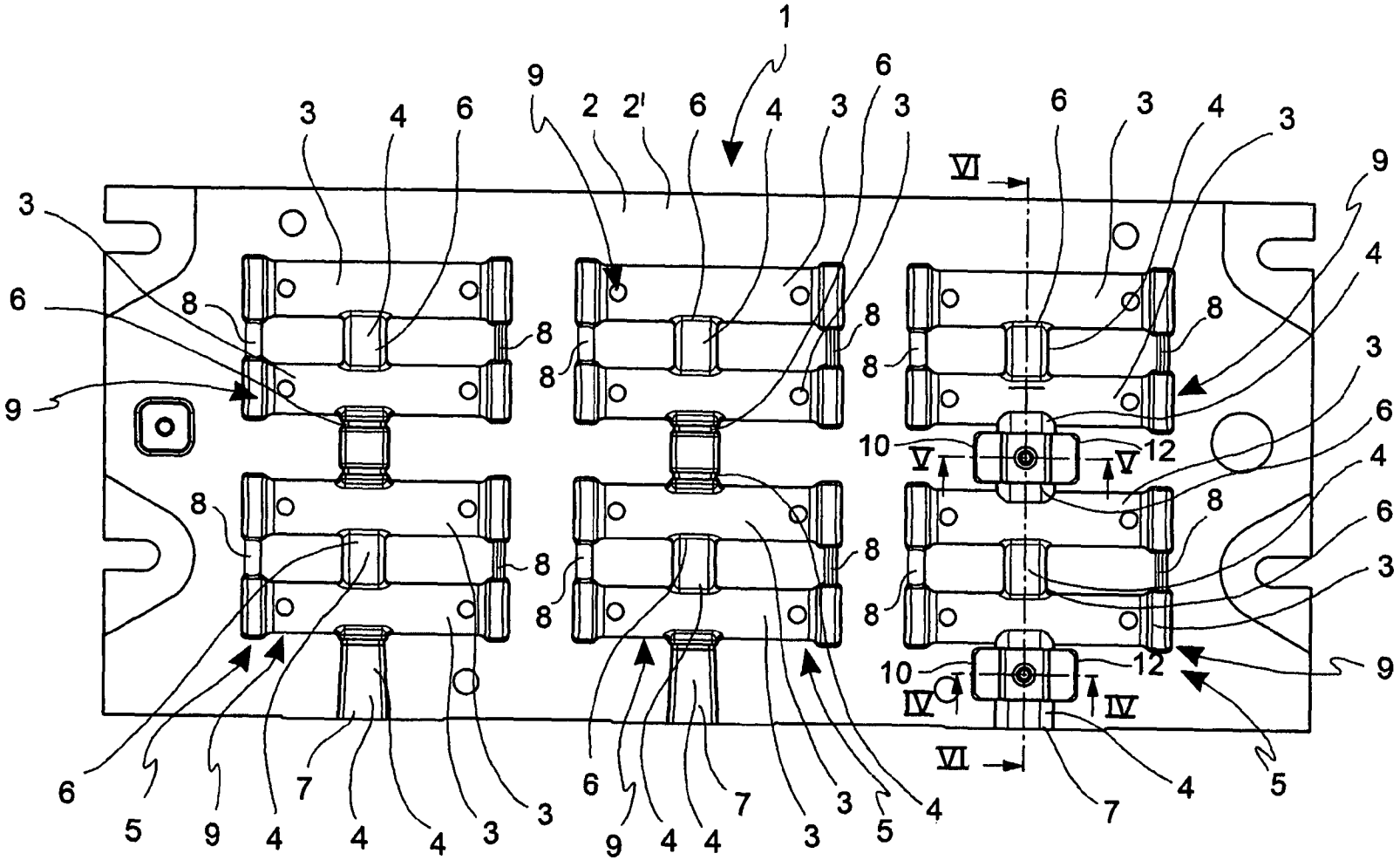
FIG. 3 is a schematic plan view of the part of equipment in FIG. 2.
Figure 4:
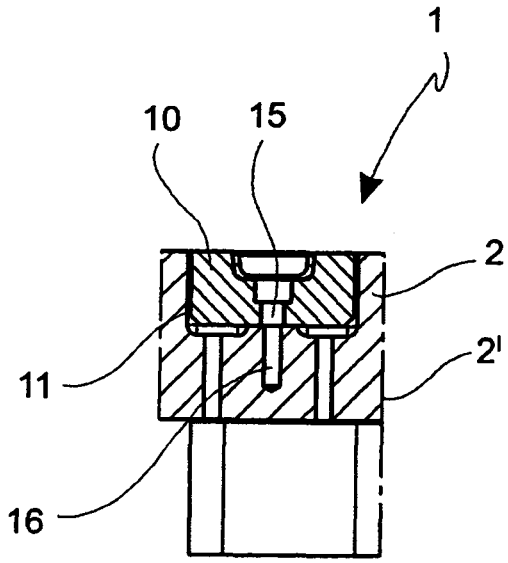
FIGS. 4, 5 and 6 are schematic section views, respectively according to the lines IV, V and VI, of the part of equipment in FIG. 3.
Figure 5:
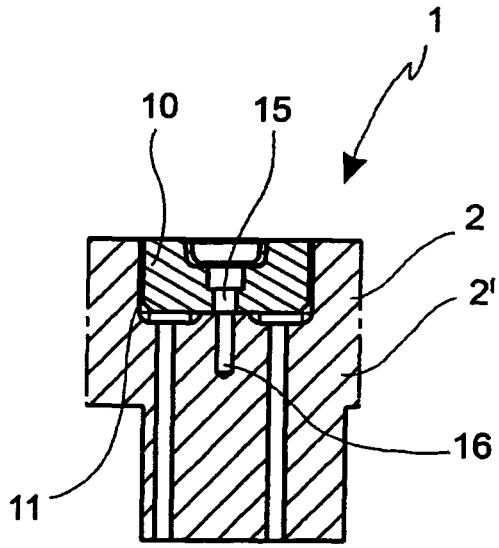
Figure 6:
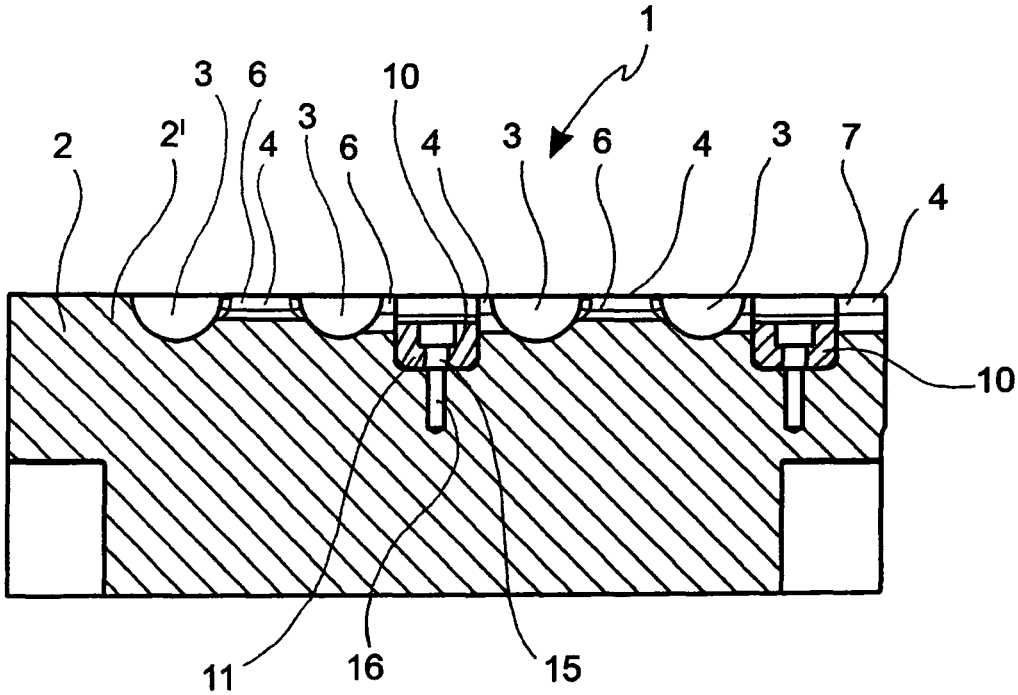

With reference to FIGS. 1-6, a piece of equipment for making foundry cores is indicated with reference numeral 1. The foundry cores (not shown in the figures) are used in melting processes to make components having specific shapes, for example components having blind holes or through holes.

The cores are made through special materials for forming cores, in particular sands for cores, preferably pre-coated sands, having a firing temperature above which they solidify and become suitably compact.

The equipment 1 for making the cores according to the present invention comprises a mould 2, preferably in turn comprising a first half-mould 2' and a second half-mould (not shown in the figures) that can be connected together. The presence of two distinct half-moulds allows them to be processed more easily and makes it possible to remove the cores once the formation process has ended.

The mould 2 includes one or more core forms 3. By the expression "core forms" we mean cavities made in the mould having substantially the same shape as the shapes that the cores must have. The core forms therefore represent the negative of the core that will be made. The sand for cores is indeed conveyed into such core forms, the enclosing walls of which have been brought to an adequate temperature in advance, and upon contact with them the solidification process begins.

Preferably, each of the core forms 3 is formed in part in the first half-mould 2' and in part in the second half-mould, in corresponding positions.

In order to convey the core formation material, in particular the sand for cores, into the core forms 3, the mould 2 comprises suitable conveying ducts 4, through which the sand reaches the core forms 3, filling them. The conveying ducts 4 are preferably formed partially in the first half-mould and partially in the second, but they can possibly be formed in just one of them.

The core forms 3 and the conveying channels 4 can be variously arranged and shaped. In accordance with the embodiment illustrated in the figures, the core forms 3 and the conveying channels are arranged according to a plurality of groups 5. Each group 5 includes a plurality of core forms 3 arranged in series and connected together through connection channels 6. A feeding channel 7 feeds the group and allows the core formation material to be fed from outside of the mould. In particular, the sand for cores enters into the mould through the feeding channel 7 of each group 5 and progressively fills all of the core forms 3 of the group itself.

It should be noted that the organisation of the conveying channels 4 and of the core forms 3 just described should be taken purely as an example. For example, it is possible for there to be a single group of core forms in the mould. It is also possible for there to be one or more groups 5 that include a single core form 3 and in this case just the feeding channel 7 is present, but not the connection channels 6. Alternatively, in the case of groups equipped with many core forms, they can be placed not in series but according to different arrangements. Further possible organisations of the core forms and of the conveying channels will be obvious to the man skilled in the art.

Advantageously, the equipment 1 comprises one or more inserts 10 that are housed or can be housed in the conveying channels 4, in particular near to the core forms 3. The inserts 10 can be arranged in the feeding channels 7. Alternatively or in addition, they can be arranged in one or more of the connection channels 6.

The arrangement of the inserts 10, the characteristics of which will be described hereafter, in the conveying channels 4 ensures that at them, and therefore in the conveying channels 4 near to the core forms 3, the solidification process of the material for making cores, in particular the firing of the sand, is altered. This means that, in the presence of the inserts, the sand does not solidify or does not completely solidify, remaining at least partially friable. Thanks to the presence of the inserts, therefore, it is possible to entirely eliminate or at least drastically reduce the formation of burrs.

Since thanks to the equipment according to the present invention the formation of burrs is totally got rid of or limited, in the overall core formation cycle the operations needed to remove them are also got rid of or limited. Moreover, in the case in which many core forms are foreseen, the cores formed are already separate and therefore cutting operations are not required to separate them. The overall time of the cycle is therefore reduced.

A further advantage linked to the equipment according to the present invention is the reduction of the overall processing costs of the cores. Indeed, the lack of formation of burrs ensures that the unsolidified sand can be reused in subsequent core formation cycles. This means a saving linked precisely to the fact that sand is not wasted. The additional cost linked to the provision of the inserts is offset with the use of the equipment in the production of cores.

In accordance with a preferred embodiment, the inserts 10 have a heat conductivity such as to locally limit the transmission of heat coming from the mould towards the conveying channels 4 where the inserts 10 are housed. As stated earlier, indeed, the sand for cores is fired through its insertion in the heated mould and progressively solidifies from the portions in contact with the heated walls of the mould after a predetermined firing temperature has been reached. The heating of the mould can take place for example by passing current through electrical resistances (not shown in the figures) associated with the mould 2. In order to make the transmission of heat from the resistances to the core forms 3 easier, the mould 2 is preferably made from material with high heat conductivity. The inserts 10 inserted in the conveying channels 4 therefore represent thermal barriers between the heated mould and the sand for cores contained in the mould at the inserts themselves. Consequently, the temperature of the contact surfaces with the sand of the inserts is lower than the temperature of the contact surfaces of the mould where the inserts are not actually foreseen. Therefore, at the inserts 10 the sand for cores does not reach the firing temperature (or at the limit it reaches it in limited portions directly in contact with the walls of the insert), whereas in the other areas of the mould, where the inserts are not foreseen, the sand reaches such a firing temperature, solidifying and compacting.

The aforementioned advantageous technical effect can be further improved through suitable configuration of the inserts.

Preferably, the inserts 10 and the mould 2 are made from different materials. Indeed, the mould 2 must ensure a high heat flow from the resistances to the sand for cores, whereas the inserts 10 should limit it as much as possible. For this purpose, the inserts 10 are advantageously made from materials having a lower heat conductivity than the heat conductivity of the mould 2. This characteristic ensures a different thermal behaviour of the equipment 1 between housing areas of the inserts and the core forms. According to a possible embodiment, the inserts 10 are made from aluminium titanate. The mould can for example be made from steel.

The inserts 10 can preferably be removably inserted into the mould 10, so as to be able to be replaced and possibly reused in combination with further moulds. According to a possible embodiment, the conveying channels 4 comprise special insert seats 11 for the insertion of the inserts 10. For example, the conveying channels 4 can comprise widened portions 12 preferably having a shape substantially matching the shape of the inserts 10, suitable for receiving the latter. The widened portions 12 can be foreseen in the feeding channels 7, and/or in the connection channels 6.

In order to block the inserts in the insert seats 11 of the mould, the equipment 1 can comprise special connection means. For example, the inserts 10 can be fixed to the mould 2 through threaded connection members (not shown in the figures).

Figure 7A:
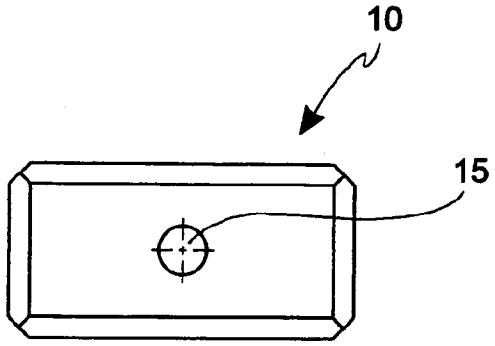
FIGS. 7*a*-7*d* are schematic side view of an insert belonging to the equipment for forming cores according to a possible embodiment of the invention.
Figure 7B:
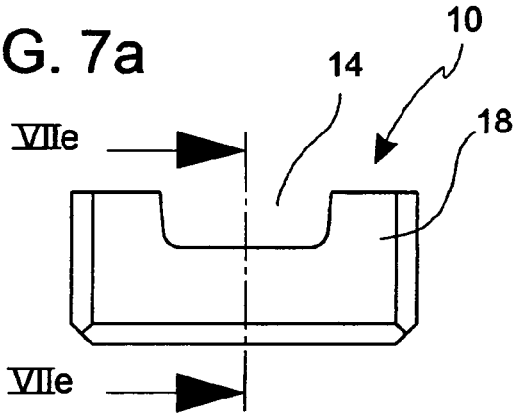
Figure 7C:
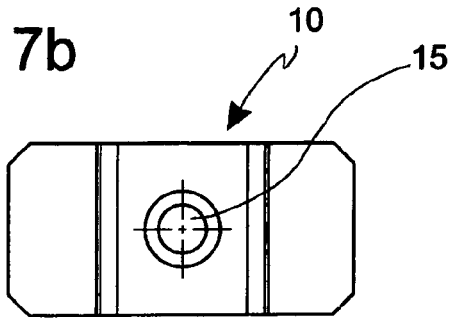
Figure 7D:
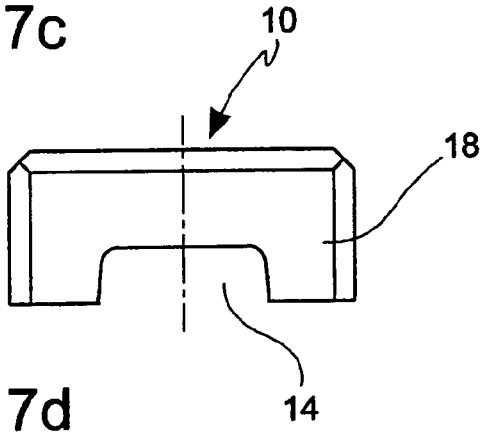
Figure 7E:
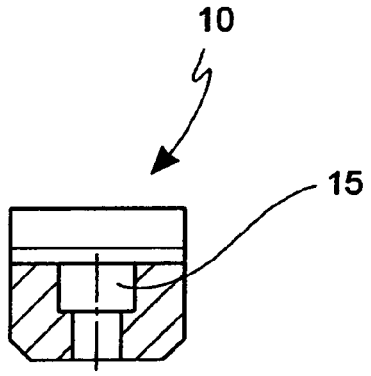
FIG. 7*e* is a schematic section view, according to the line VIIe, of the insert in FIG. 7*b;*
Figure 7F:
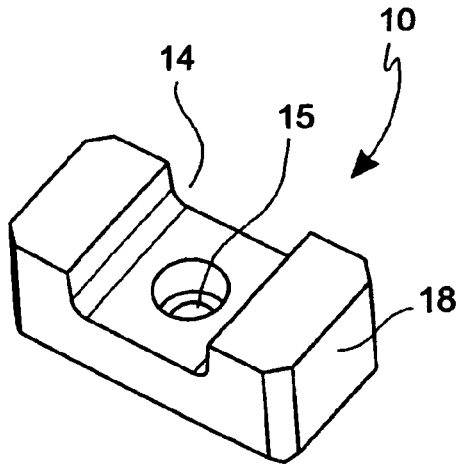
FIG. 7*f* is a schematic perspective view of the insert in FIGS. 7*a*-7*e;*
Figure 8A:
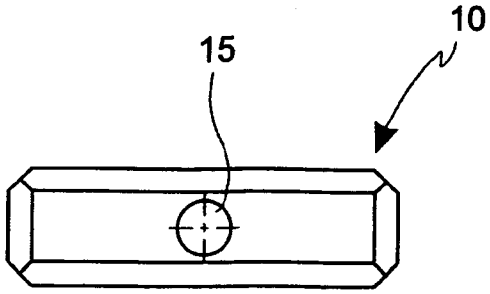
FIGS. 8*a*-8*d* are schematic side views of an insert belonging to the equipment for forming cores according to a possible further embodiment of the invention.
Figure 8B:
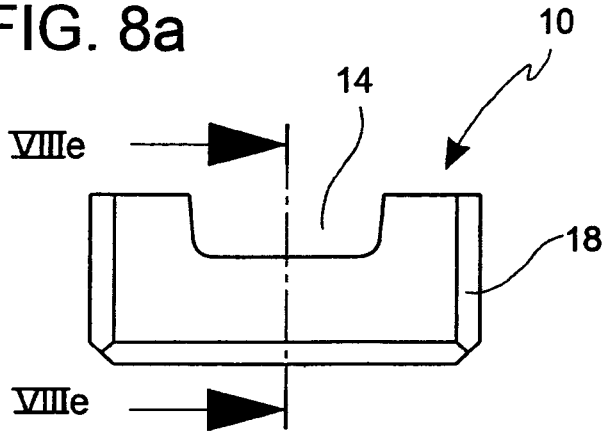
Figure 8E:
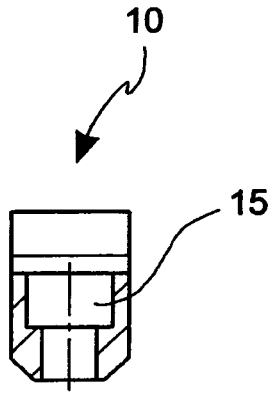
FIG. 8*e* is a schematic section view, according to the line VIIIe, of the insert in FIG. 8*b;*
Figure 8C:
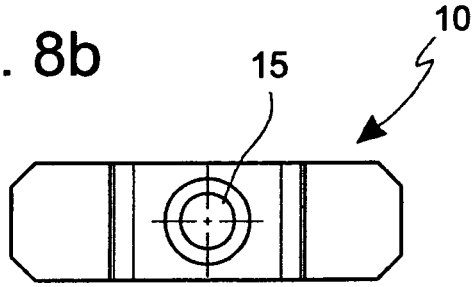
Figure 8F:
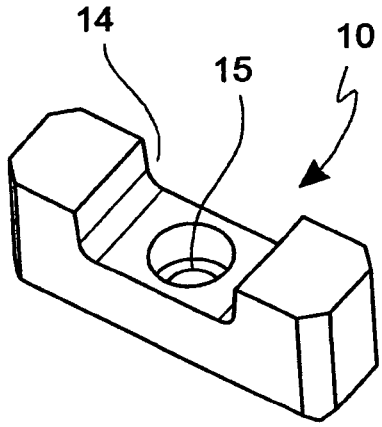
FIG. 8*f* is a schematic perspective view of the insert in FIGS. 8*a*-8*e;*
Figure 8D:
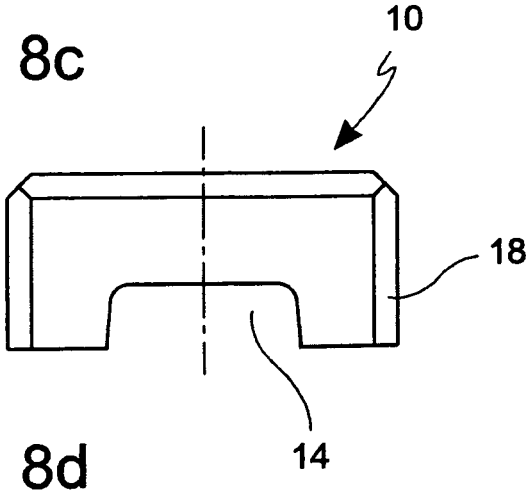
Figure 9A:
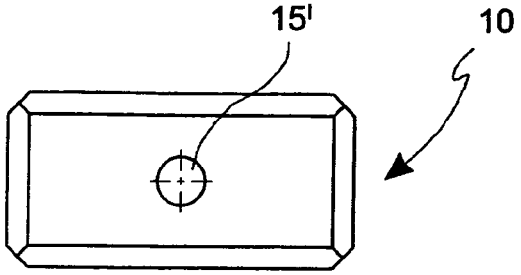
FIGS. 9*a*-9*d* are schematic side views of an insert belonging to the equipment for forming cores according to a possible further embodiment of the invention.
Figure 9B:
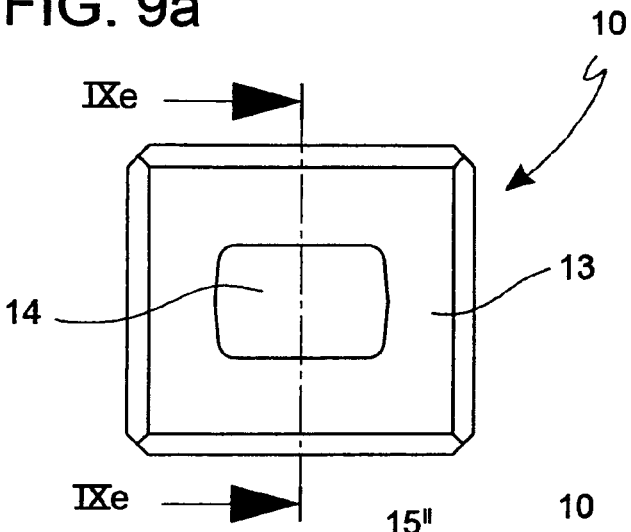
Figure 9E:
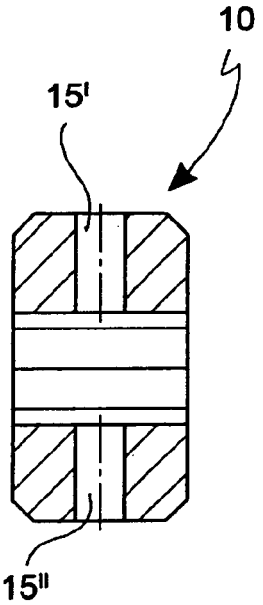
FIG. 9*e* is a schematic section view, according to the line IXe, of the insert in FIG. 9*b;*
Figure 9C:
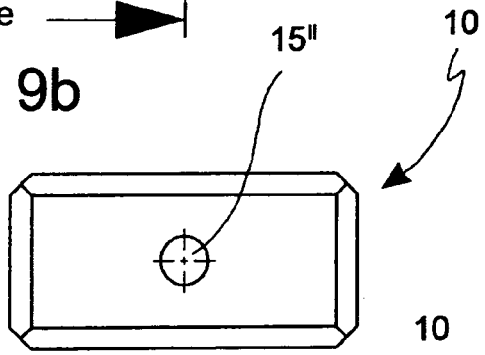
Figure 9D:
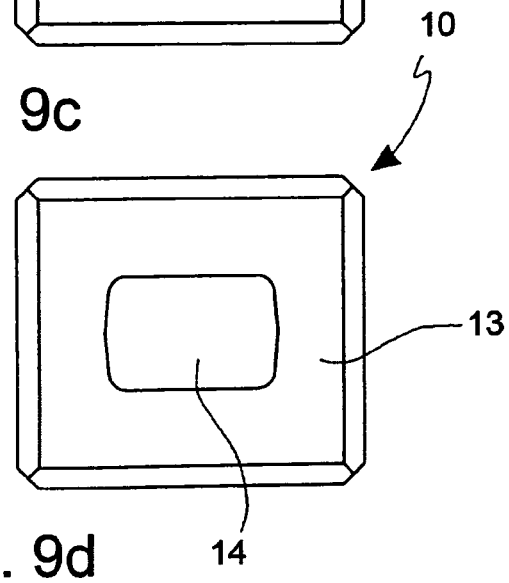
Figure 9F:
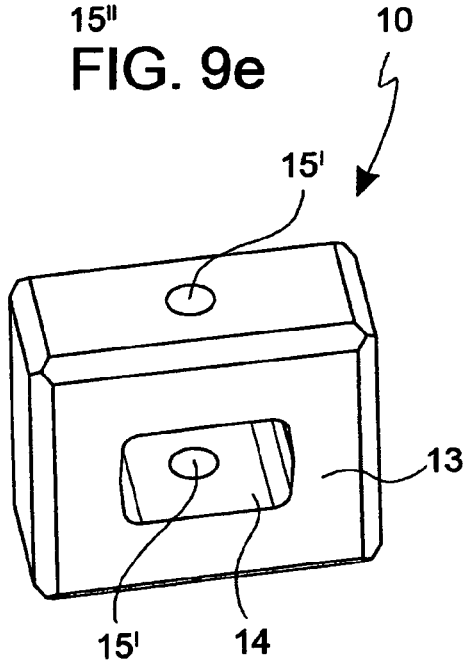
FIG. 9*f* is a schematic perspective view of the insert in FIGS. 9*a*-9*e;*
Figure 10A:
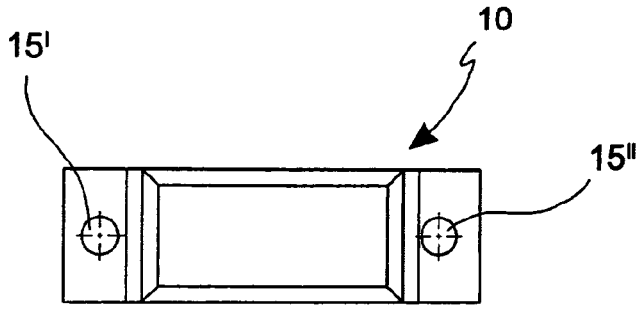
FIGS. 10*a*-10*d* are schematic side views of an insert belonging to the equipment for forming cores according to a possible further embodiment of the invention.
Figure 10B:
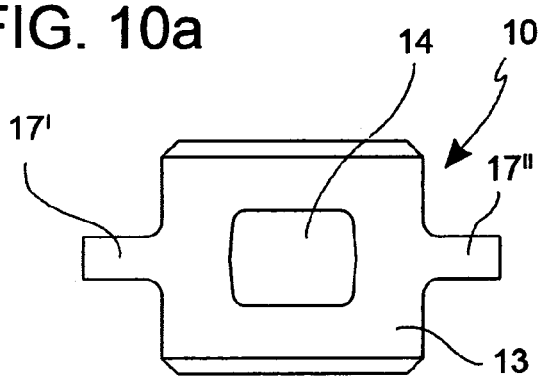
Figure 10C:
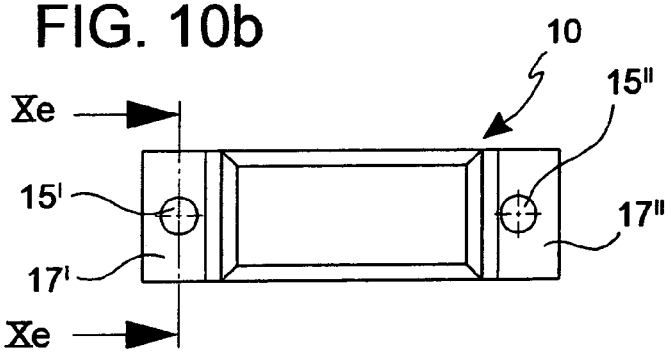
Figure 10D:
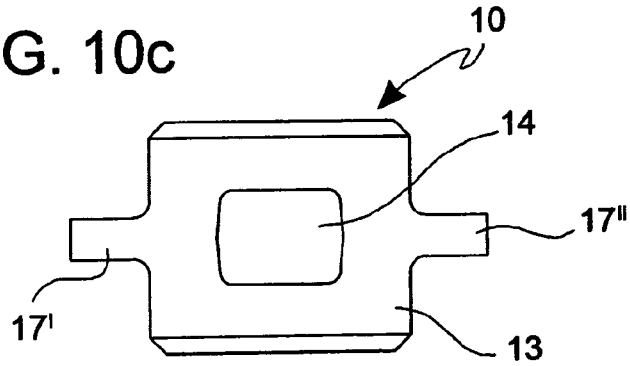
Figure 10E:
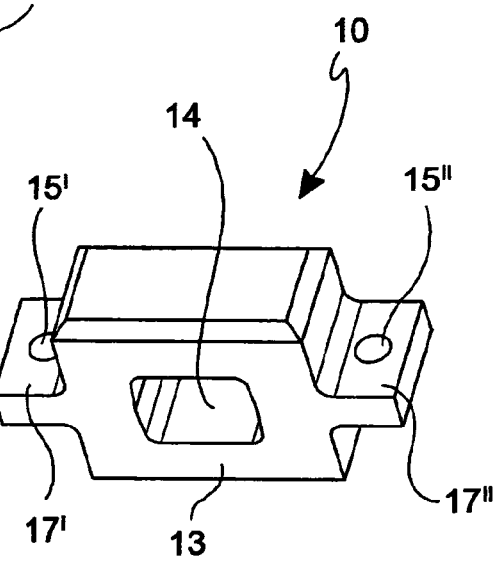
FIG. 10*e* is a schematic section view, according to the line Xe, of the insert in FIG. 10*b;*
Figure 10F:
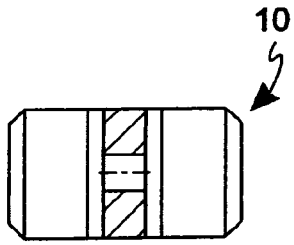
FIG. 10*f* is a schematic perspective view of the insert in FIGS. 10*a*-10*e.*

The inserts 10 can have various configurations (FIGS. 7-10).

In accordance with a possible embodiment, the inserts 10 comprise a ring-shaped portion 13 that defines an opening 14 for the passage of the core formation material.

The passage opening 14 preferably has a shorter extension than the extension of the corresponding conveying channel 4 in which the insert 10 is inserted. In this way, at the inserts, not only is the thermal behaviour described earlier obtained, but a structurally weak area is made in the material for the formation of cores, said area thus being not very strong since it has a low resistant section, and therefore easy to remove in the case in which partial solidification of the material occurs.

In accordance with a possible embodiment, the inserts 10 are made in two distinct pieces (FIGS. 7*a*-7*f*; 8*a*-8*f*). In particular, a first piece 10' is intended to be housed in the first half-mould 2', and a second piece (not shown in the figures) is intended to be housed in the second half-mould. The insert seats 11, the mould 2 and the inserts 10 themselves are advantageously configured so that, when the mould is closed, the first piece of insert and the second piece of insert are arranged adjacent to one another and make a substantially continuous body, as if it were made in a single piece. Each of the two pieces of insert comprises substantially a C-shaped body. In such a body there is preferably a through hole 15 through which a threaded member (not shown in the figures) can be made to pass, suitable for engaging a corresponding threaded seat 16 in the mould, in particular in the widened portions 12 of the insert seats 11 (regarding this, see for example FIGS. 4-6).

Such inserts can be made in different sizes and proportions, according to the type of mould with which they will be associated. Regarding this, see for example the embodiment in FIGS. 7*a*-7*f* and the embodiment in FIGS. 8*a*-8*f*, which respectively illustrate inserts having similar shapes but different proportions.

According to further possible embodiments, the inserts 10 are made in a single piece (FIGS. 9*a*-9*f*, 10*a*-10*f*). In this case, each insert, with the moulds closed, is preferably housed partially in the first half-mould 2' and partially in the second half-mould. In order to make the connection with one of the two half-moulds, such an insert 10 preferably has a first 15' and/or a second 15" through hole for the passage of as many threaded members suitable for engaging corresponding threaded holes formed in the first or in the second half-mould.

In accordance with a further possible embodiment, the inserts comprise a first 17' and a second 17" side flange (FIGS. 10*a*-10*f*). Such side flanges 17' and 17" are suitable for being received in corresponding flange seats (not shown in the figures) associated with the widened portions 12 of the conveying channels 4 of the mould 2. Each of such side flanges 17' and 17" preferably includes a first 15' and a second 15" through holes for the connection of the insert 10 to the mould 2, in particular through threaded members suitable for engaging corresponding threaded seats. Of course, although this last embodiment of the insert has been described as made in a single piece, it is also possible to foresee an insert with the same configuration, but made in two distinct pieces.

From the description provided above the man skilled in the art can appreciate how the equipment for making foundry cores according to the present invention allows a saving in terms of time and money in the production cycle of foundry cores.

Indeed, the presence of the inserts ensures that locally the material for making the cores does not solidify, entirely or partially, and therefore that the burrs do not form at all or at least partially. Moreover, in the case in which many core forms are foreseen, the cores formed are already separate and therefore cutting operations are not required to separate them.

The sand that is not used up in the formation of burrs can be reused in further cycles, without being wasted.

The additional cost linked to the provision of the inserts is offset with the use of the equipment in the production of cores.

From the description provided above of the equipment for making foundry cores according to the invention the man skilled in the art can bring numerous modifications additions or replacements of elements with other functionally equivalent ones, in order to satisfy contingent specific requirements, without however departing from the scope of the attached claims. Each of the characteristics described as belonging to a possible embodiment can be made independently from the other described embodiments.

The invention claimed is:

1. An apparatus for manufacturing foundry cores comprising, a mould arranged with a plurality of core boxes, one or more ducts for conveying core formation material to said plurality of core boxes, and a plurality of inserts, one or more inserts housed in the one or more ducts in proximity to the plurality of core boxes; wherein said plurality of core boxes are arranged in one or more groups, each group including a plurality of core boxes arranged in series and connected together through connection channels, wherein one or more of the plurality of inserts are arranged in one or more of the connection channels such that the formation material does not solidify or does not completely solidify remaining at least partially friable in the presence of said insert.

2. The apparatus of claim 1, wherein the plurality of inserts the one or more inserts limit the transmission of heat coming from the mould where the plurality of inserts are housed.

3. The apparatus of claim 1, wherein the plurality of inserts have a thermal conductivity less than the thermal conductivity of the mould.

4. The apparatus of claim 1, wherein the plurality of inserts and the mould are comprised of different materials.

5. The apparatus of claim 1, wherein the plurality of inserts comprise aluminium titanate.

6. The apparatus of claim 1, wherein the plurality of inserts and the one or more conveying ducts are arranged according to one or more conveying duct groups, each of said conveying duct groups comprising one or more core boxes mutually connected by one or more connecting ducts of the one or more conveying ducts, and a supply duct of said conveying ducts for supplying the core formation material from the exterior to the interior of the mould.

7. The apparatus of claim 6, wherein the plurality of inserts are arranged in the one or more supply ducts and/or in the one or more connecting ducts.

8. The apparatus of claim 1, wherein the conveying ducts comprise insert seats having expanded portions for housing said inserts.

9. The apparatus of claim 8, wherein the expanded portions are substantially complementary to said inserts.

10. The apparatus of claim 1, wherein the plurality of inserts comprise portions having a substantially annular shape, so as to define a through-opening allowing passage of the core formation material.

11. The apparatus of claim 10, wherein the through-openings extend below the transversal extent of the conveying ducts in which the plurality of inserts are housed.

12. The apparatus of claim 1, wherein the plurality of inserts include side flanges suitable for being received in corresponding mould flange seats.

13. The apparatus of claim 1, wherein the plurality of inserts are manufactured as a single insert piece.

14. The apparatus of claim 1, wherein the plurality of inserts are manufactured as two distinct insert pieces.

15. The apparatus of claim 14, wherein the two distinct insert pieces are substantially mutually the same.

16. The apparatus of claim 1, wherein the mould includes a first half-shell and a second half-shell which are removably connectable, the one or more inserts being received partially in said first half-shell and partially in said second half-shell when each of said first and second half-shell are connected to form said mould.

* * * * *